US006397770B1

(12) United States Patent
Syvertsen et al.

(10) Patent No.: US 6,397,770 B1
(45) Date of Patent: Jun. 4, 2002

(54) SHIP FOR OFFSHORE OPERATIONS WITH VERTICAL OPENINGS

(75) Inventors: Kåre Syvertsen, Arendal; Arne Smedal, Færvik, both of (NO)

(73) Assignee: Hitec Systems As., Stavanger (NO)

( * ) Notice: Subject to any disclaimer, the term of this patent is extended or adjusted under 35 U.S.C. 154(b) by 0 days.

(21) Appl. No.: 09/627,335

(22) Filed: Jul. 28, 2000

Related U.S. Application Data

(63) Continuation of application No. PCT/NO99/00034, filed on Feb. 3, 1999.

(51) Int. Cl.[7] ..... B63B 3/00
(52) U.S. Cl. ..... 114/65 R
(58) Field of Search ..... 166/352–355; 175/7, 8; 114/264, 265; 441/3–5

(56) References Cited

U.S. PATENT DOCUMENTS 4,081,163 A 3/1978 Guinn et al. ..... 248/2
4,281,716 A 8/1981 Hall ..... 166/339
4,604,961 A * 8/1986 Ortloff et al. ..... 114/230
5,833,397 A * 11/1998 Horton, III ..... 405/204

* cited by examiner

*Primary Examiner*—Ed Swinehart
(74) *Attorney, Agent, or Firm*—Fitch, Even, Tabin & Flannery

(57) ABSTRACT

A ship for use in offshore operations, with one or more vertical openings (moonpools) in the hull, wherein the deck and/or hull bottom areas between or substantially between and/or otherwise adjacent the openings, are displaced relative to the rest of the deck and/or hull bottom areas of the ship to a position closer to the ship's transverse neutral axis. The area between the rest of the other deck- and hull bottom areas and substantially the displaced area or areas at the openings in the ship and the rest of the deck- and/or hull bottom areas can be stepped in one or more steps, or be shaped as an approximately linear or arcuate junction.

7 Claims, 4 Drawing Sheets

SHIP FOR OFFSHORE OPERATIONS WITH VERTICAL OPENINGS

This is a continuation, of prior application number PCT/NO99/00034 filed Feb. 3, 1999, and designating the United States of America, which is hereby incorporated herein by reference in its entirety.—The entire disclosure of the prior application, is considered as being part of the disclosure of the accompanying application, and is hereby incorporated by reference therein.

The present invention relates to a ship for use in offshore operations which has one or more vertical openings in the hull, so-called moonpools. Openings in the hull of a ship which, e.g., is to be used as a drill ship, are quite common today, occurring both singly and severally, and are used for a variety of tasks. In some situations it is desirable to arrange fixedly mounted equipment in proximity to such a moonpool in order to carry out specific tasks. This could be, e.g., a derrick, a crane arrangement for launching and taking up, for instance, ROV, or other equipment for the execution of operations through these openings in the hull.

The openings are usually arranged along the longitudinal centre line of the ship and may be of a variety of cross-sectional shapes and sizes, but often they are rectangular or approximately rectangular, and if there are several openings, these are arranged one after the other along the longitudinal centre line of the ship and may have the same cross-sectional shape and size. If the openings are not used for specific tasks, they may be built into a ship to have an impact on its motions The rectangular openings have an effect on the stress distribution in, inter alia, the deck and hull bottom plates when the ship is exposed to stresses caused by waves and other loads. In some areas, notches may occur which result in concentrations of stress, where the level of stress may be considerably higher than the average stresses in the deck or hull bottom plates. Stress concentrations will occur in particular at the corners of rectangular openings, even though the corners are designed so as to minimise notch effect. It is also possible to alleviate the situation by designing bracket plates and local reinforcements appropriately, but the stress concentration factor will often be high, and a stress concentration factor of 2 is by no means unusual.

When designing and constructing a drill ship, it will be necessary to take such local stress concentrations into account, and they form the basis for calculating, inter alia, the fatigue life of a ship. Under certain operating conditions, such as, e.g., long-term operations in the North Sea, fatigue may be a decisive criterion for the dimensioning of a typical transverse section of a drill ship. In practice, this means that the dimensions of the deck and hull bottom plates must be increased considerably to meet the fatigue capacity requirements. In addition to the production process being more complex, this will also involve substantially higher costs. Furthermore, the load picture and the stress distribution will be more complicated and uncertain when, e.g., a derrick for use through the hull opening is to be fixedly mounted in the area of stress concentrations, or in proximity to such areas. When positioning fixed equipment of this kind, it is of course an advantage that stresses and stress concentration should be the lowest and most uniform possible with no local stress concentrations, or the potential for these. This may also result in designs that are simpler to produce, which in turn will help to reduce costs in connection with the production of the ship.

The conventional notion of stress distribution in deck and hull bottom plates is that the stresses in the deck and hull bottom plates will, when the ship is exposed to stresses caused by waves and other loads, increase approximately linearly with the distance from the transverse neutral axis of the ship. In other words, the deck and hull bottom plates which are arranged furthest from the ship's transverse neutral axis will have the highest stress level. Furthermore, the stresses are intensified in local stress concentrations as a result of the design of the deck and hull bottom plates, if included in this design there are elements which produce notch effect. These elements may be sharp corners, openings, welded-in equipment or the like. Thus, on the basis of these factors, two solutions for the reduction of the stress concentrations become evident. One of these is to reduce the notch effect in the deck and hull bottom plates, and the other solution, towards which the present invention is directed, concentrates on the positioning and design of the deck and hull bottom plates at the site of cut-outs which, e.g., are rectangular, in relation to the transverse neutral axis of the ship.

SUMMARY OF THE INVENTION

The invention relates to a ship as disclosed in the preamble of claim 1, having the characteristics that are disclosed in the characterising clause of claim 1. Additional embodiments of the invention are disclosed in the other claims.

If the ship's deck and hull bottom plates which have cut-outs for moonpools are placed closer to the transverse neutral axis, the average stress level will be lower, and the stress concentrations resulting from notches will be smaller. This in turn will be a major consideration when dimensioning of the deck and hull bottom plates, and especially in relation to dimensioning for dynamic load and fatigue life. On drill ships having moonpools, as covered by the present application, there will at all times be stress concentrations as a result of notches at the points where the openings, or the so-called moonpools, pass through the deck and hull bottom plates. By displacing these deck and hull bottom plates, or optionally just the deck plate or the hull bottom plate towards the transverse neutral axis of the ship, a lower average stress level will be obtained. This will give lower stress peaks and thus help to reduce the need for plate thickness, which in turn results in a less costly ship.

In the proposed arrangement, the deck plates (on the upper deck) and the bottom plates on the side of the moonpool will be continuous without any cut-outs which result in notches and thus stress concentrations.

BRIEF DESCRIPTION OF THE DRAWINGS

The invention will now be explained in more detail with reference to the following figures.

DETAILED DESCRIPTION OF PREFERRED EMBODIMENTS

Figure 1:
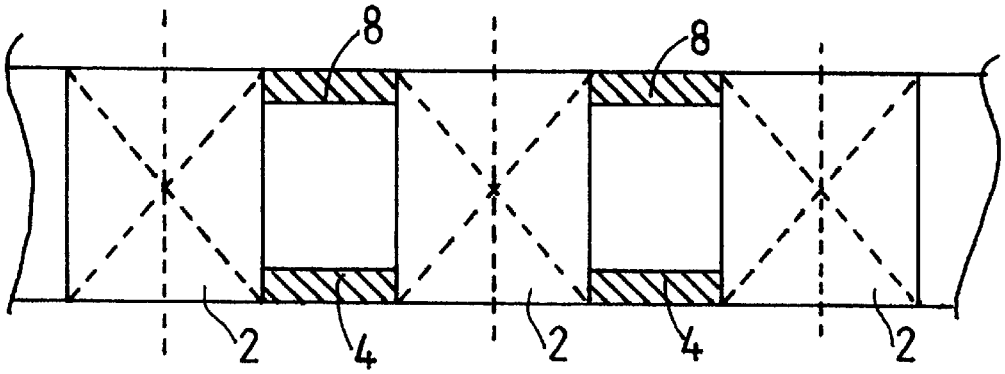
FIG. 1 is a lateral sectional view of a hull with three moonpools taken through the centre line of the ship, wherein the deck and hull bottom plates between each moonpool are displaced in accordance with the present invention.
Figure 4:
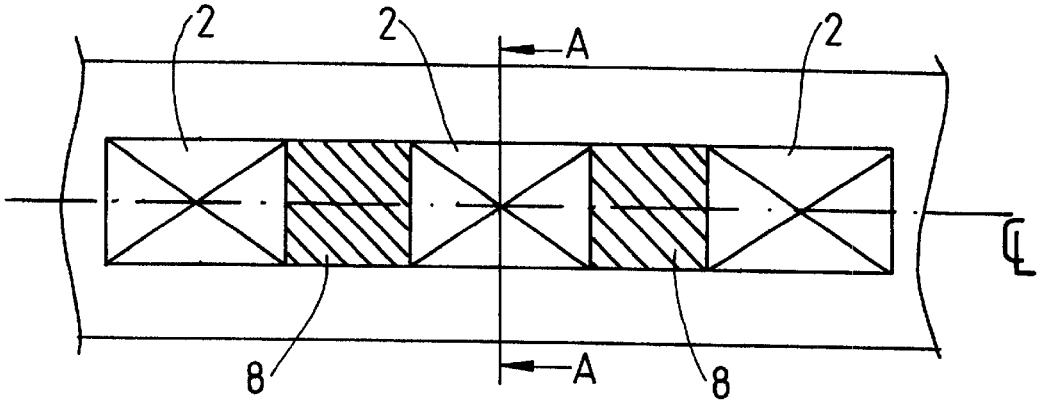
FIG. 4 is a top view of the hull as shown in FIG. 1.

One embodiment of the present invention is indicated in FIG. 1 in a lateral sectional view through the centre line of a hull having three through-going vertical openings 2, also known as moonpools, positioned one after the other in the longitudinal direction. In accordance with the invention, the deck area 8 and the hull bottom area 4 between each of the openings 2 have been displaced in such a way that the deck plates 8 are displaced down towards the ship's transverse neutral axis 20, and similarly the hull bottom plates 4 are displaced relative to the rest of the ship's hull bottom, towards the ship's transverse neutral axis 20. This can also be seen from FIG. 4, where the same construction as that in FIG. 1 is shown in a top view, wherein the openings, or the moonpools 2, are positioned along the centre line of the ship with deck areas 8 therebetween. The hatched deck areas 8 have thus been moved to an area where the average stress level is lower, and as a result of this positioning, the impact of the notch effect at corners etc. will be reduced.

Figure 2:
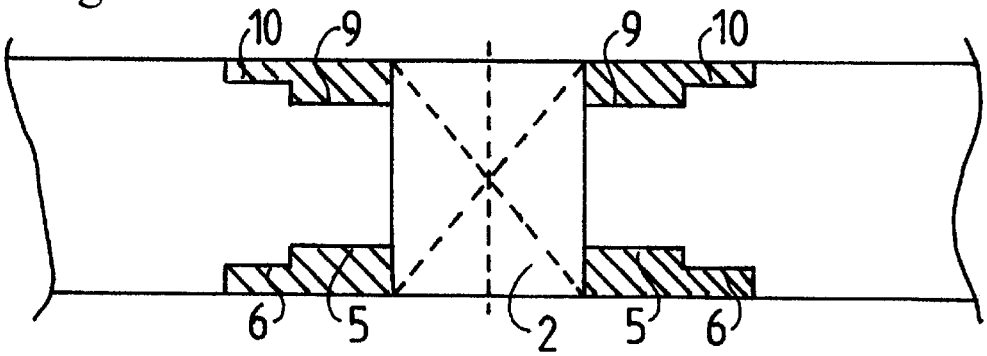
FIG. 2 is a lateral sectional view of a ship with one moonpool taken through the centre line of the ship, wherein the deck and hull bottom plates abaft of and forward of the moonpool are displaced in accordance with an embodiment of the present invention.
Figure 5:
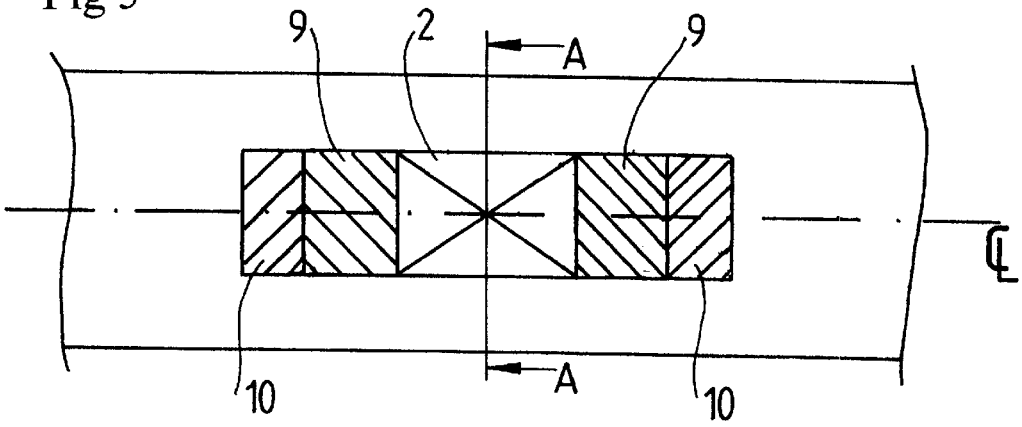
FIG. 5 is a top view of the hull shown in FIG. 2.

FIG. 2 is a lateral sectional view of a hull with a moonpool 2 taken through the centre line. The deck area on each side of the moonpool is divided into the areas 9 and 10, both of which are displaced towards the ship's transverse neutral axis 20 relative to the rest of the deck. Furthermore, the hull bottom plates 5 and 6 have also been displaced in a vertical direction towards the transverse neutral axis 20 of the ship. Like the displacement of areas 4, 8 in FIG. 1, this results in a lower average stress level in the deck and hull bottom plates. The solution in FIG. 2 differs from that in FIG. 1 in that in this case it is the deck and hull bottom plate areas in the forward and after edge of the moonpool 2 that have been displaced, whilst in FIG. 1 it is only the areas between each individual moonpool that are displaced. Apart from these two solutions, a combination is conceivable in a ship having more than one moonpool, wherein the deck and hull bottom areas between the moonpools may be displaced towards the transverse neutral axis 20 of the ship, whilst the deck and hull bottom areas on the forward and after sides of the row of moonpools may also be displaced towards the ship's transverse neutral axis 20. The solution in FIG. 2 is also shown in FIG. 5 in a top view, where it is shown clearly that the deck areas 9 and 10 at the forward and after ends of the moonpool 2 only cover a part of the ship's deck area. Both the displacement of the deck plates 9 and 10 and the displacement of the hull bottom plates 5 and 6 are arranged stepwise so that the deck plates 9 and the hull bottom plates 5 are displaced further in a vertical direction towards the ship's transverse neutral axis 20 than the deck plates 10 and the hull bottom plates 6. This is done to further reduce the notch effect, thereby helping to reduce the stress concentrations in the construction of the deck area and hull bottom area in addition to the displacement thereof towards an area having a lower average stress level.

Figure 3:
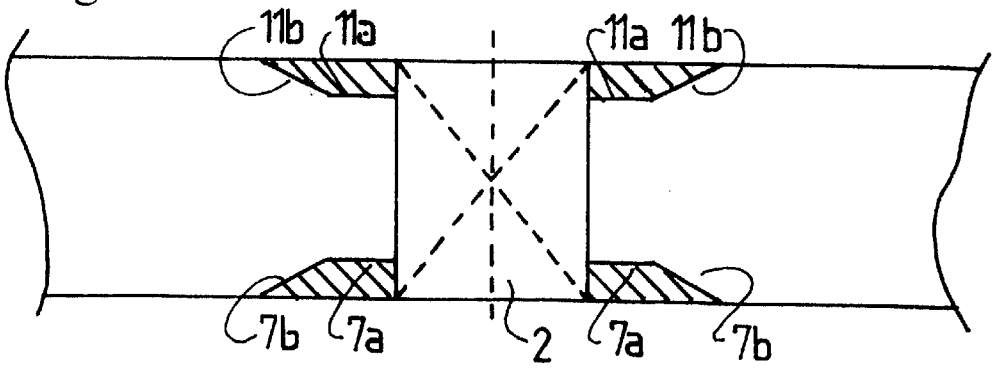
FIG. 3 is a lateral sectional view of a ship with one moonpool taken through the centre line, wherein the deck and hull bottom plates are displaced in accordance with an embodiment of the present invention.
Figure 6:
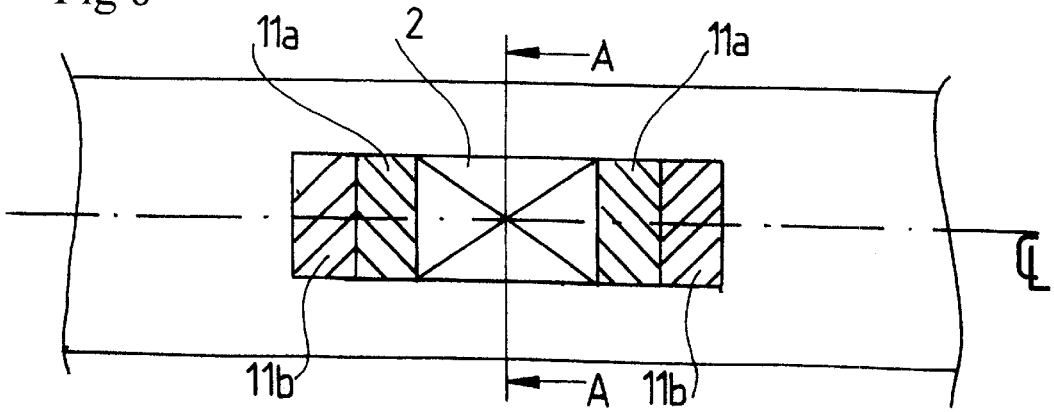
FIG. 6 is a top view of the hull shown in FIG. 3.

Another alternative embodiment is disclosed in FIG. 3, which shows a lateral sectional view of a hull with one moonpool 2 taken through the centre line, and the deck areas on the after and forward sides of the moonpool are displaced in accordance with the invention at deck areas 11*a* and 11*b*. Furthermore, the hull bottom plate areas on the forward and after sides of the moonpool 2 are displaced at the hull bottom plates 7*a* and 7*b*. In contrast to the solution disclosed in FIG. 2, the junction between the displaced areas and the rest of the surrounding deck and hull bottom plate areas is indicated by an approximately linear inclined plane 7*b*, 11*b*, which is also a design model for reducing the notch effect in the areas around the moonpool. This, in addition to the displacement of the deck areas towards the ship's transverse neutral axis 20, where the average stress level is lower, will help to reduce the stress concentration in the areas around the moonpool 2. The solution from FIG. 3 is also shown in a top view in FIG. 6.

The degree of displacement of the deck plate or hull bottom plate towards the ship's transverse neutral axis 20, in accordance with the present invention, may vary according to the average stress level that is desirable, whilst the practical considerations relating to the design of the ship will prevail with respect to the positioning of these deck and hull bottom plates.

Figure 7:
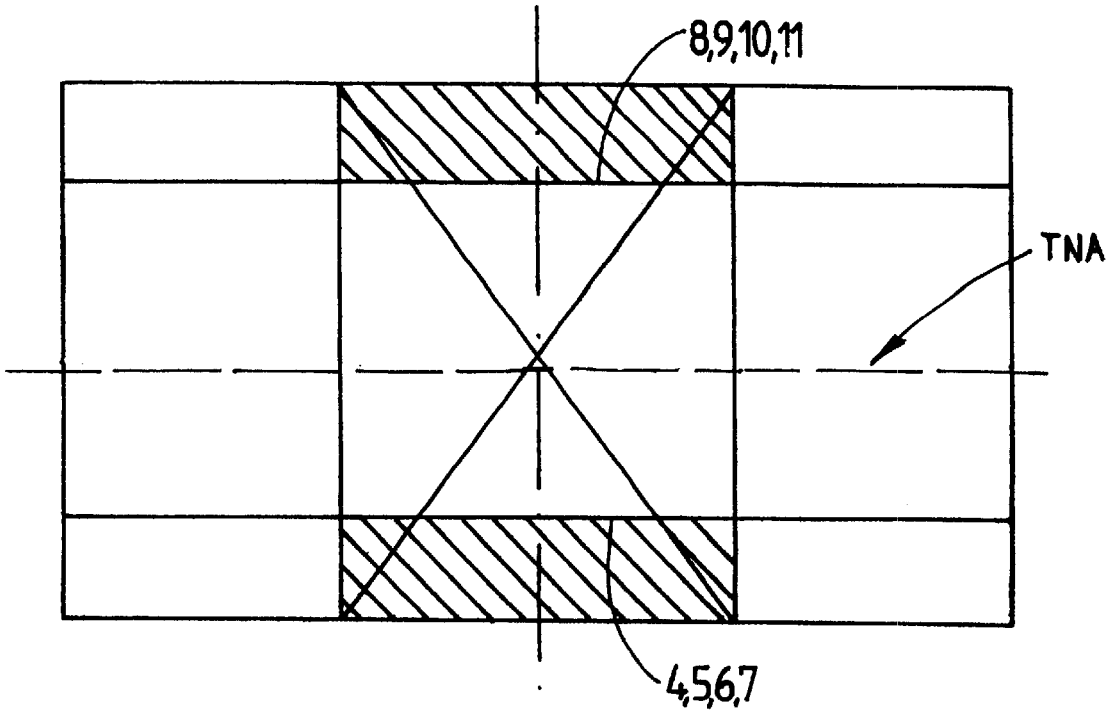
FIG. 7 is a transverse section in the centre of a moonpool of a ship having a double bottom and double deck, wherein the deck and hull bottom plates are arranged in accordance with the present invention.

FIG. 7 shows a transverse section of a ship having a double bottom and "double" deck and a centrally located moonpool 2. In accordance with the present invention, the deck area and hull bottom area at the forward and/or after side of the moonpool are displaced relative to the rest of the deck area and hull bottom area towards the ship's transverse neutral axis. In FIG. 7, this has been done by removing the upper deck plate and lower hull bottom plate in the double deck and double bottom construction, thereby displacing the deck plate area and the hull bottom area in the vertical direction to the position of the lower deck plate and the upper hull bottom plate. The local stress notches around the moonpool have been moved to a level where the average stress level in the cross section is lower. If this displacement achieves a reduction in the average stress level of 20–40%, it could at a rough estimate have the effect of increasing fatigue life by something in the range of 100 to 200%.

Figure 8:
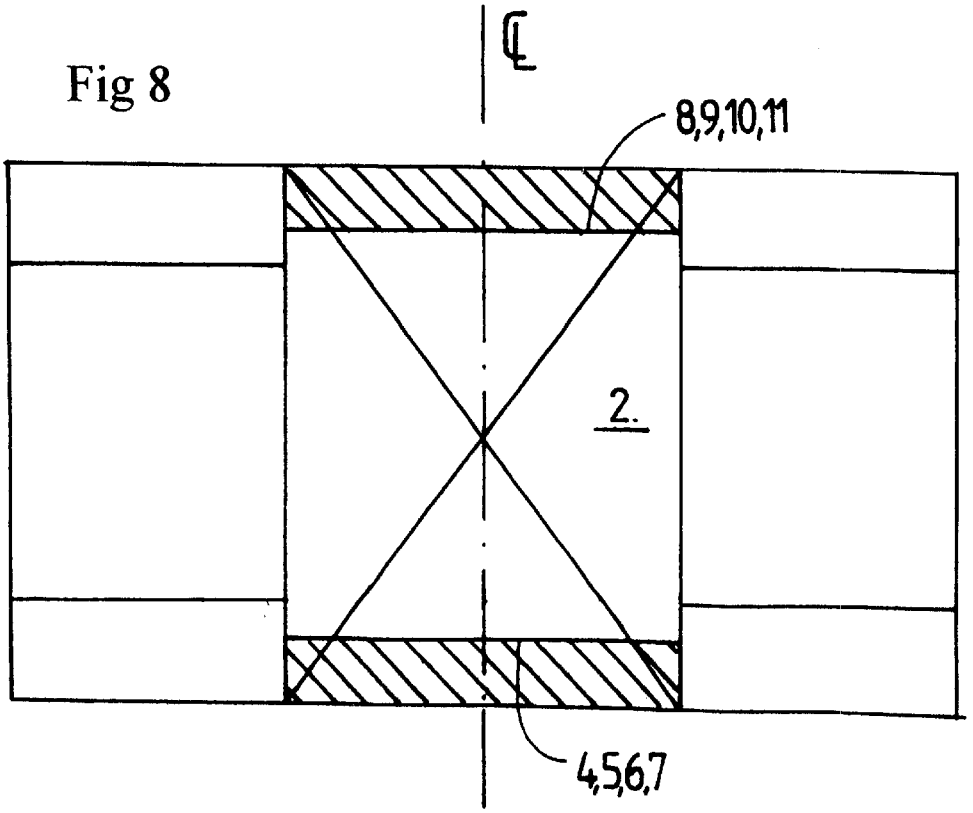
FIG. 8 is a transverse section in the centre of a moonpool of a ship having a double bottom and double deck, wherein the deck and hull bottom plates are arranged in accordance with the present invention.

FIG. 8 also shows a transverse section of a hull having a moonpool 2 wherein there is provided both a double deck and a double bottom. In this case, the deck area and the hull bottom area on each side of the moonpool have been displaced in the vertical direction towards the ship's transverse neutral axis by placing a separate deck level between the upper and lower deck in the double deck configuration, and also a separate hull bottom level between the upper and lower bottom in the double bottom construction.

Figure 9:
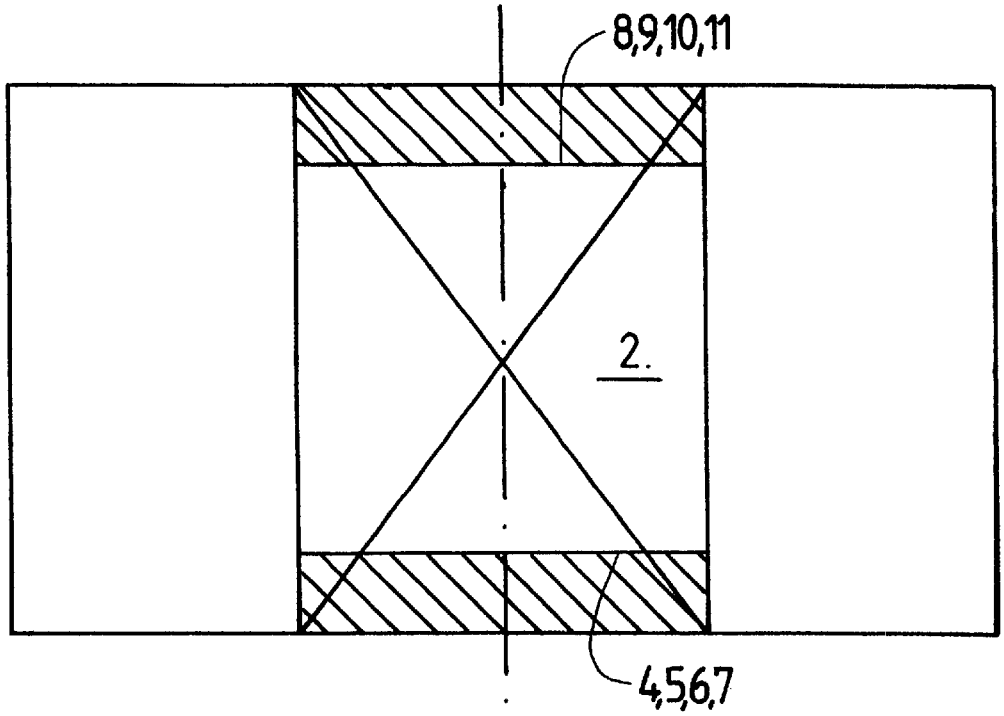
FIG. 9 is a transverse section in the centre of a moonpool of a ship having a single bottom and single deck, wherein the deck and hull bottom plates are arranged in accordance with the present invention.
Figure 10:
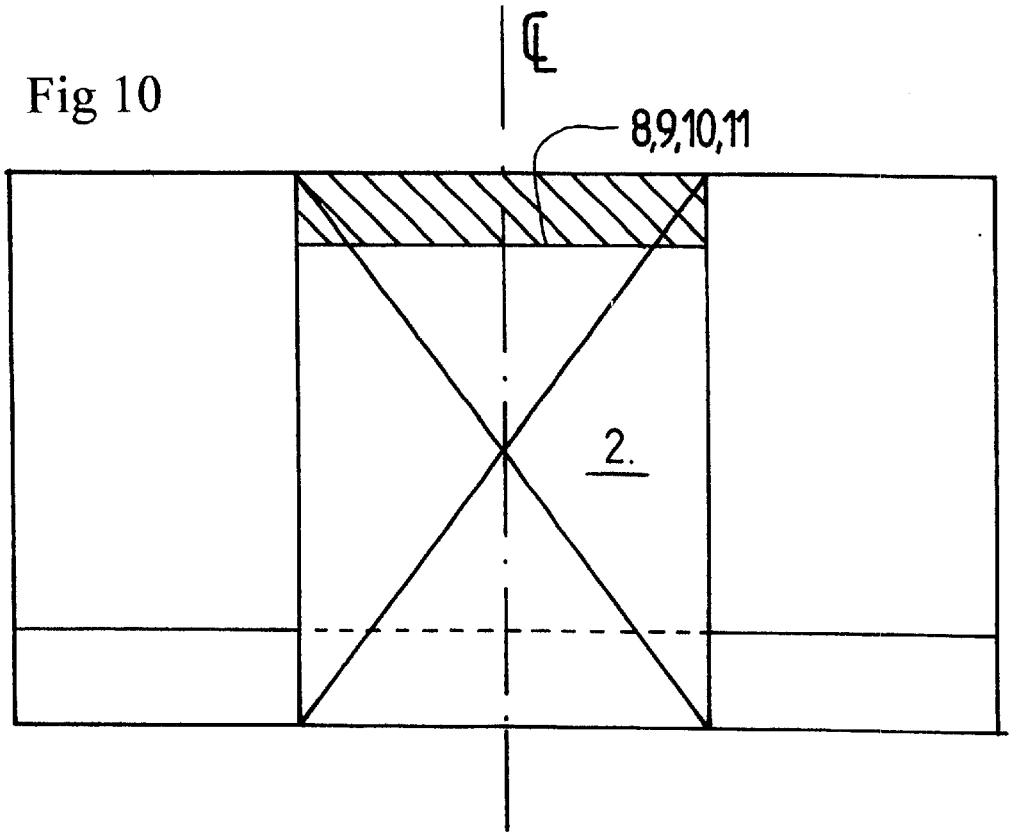
FIG. 10 is a transverse section in the centre of a moonpool of a ship having a double bottom but not a double deck. The deck plate at the moonpool is displaced in accordance with the present invention.

FIG. 9 shows a transverse section of a hull with moonpool 2, wherein there is provided a single deck and a single hull bottom. In this case, the displacement of the deck area and hull bottom area on each side of the moonpool has not been related to any lower deck levels or upper hull bottom levels, and the advantageous effect of the invention has been achieved here simply by displacing a part of the deck area and the hull bottom area in the vertical direction towards the transverse neutral axis of the ship. The displacement of the deck area and the hull bottom area need not be symmetrical by their being displaced an equal distance towards the transverse neutral axis. Similarly, it is not necessary to displace both deck area and hull bottom area, which is illustrated in FIG. 10. This figure shows a transverse section of a hull with moonpool 2 where only the deck area has been displaced in the vertical direction towards the ship's transverse neutral axis.

Within the scope of the exemplary embodiments described above, a ship having one or more moonpools is conceivable, wherein one or more of the areas between these moonpools may be displaced in the vertical direction towards the ship's transverse neutral axis. The displacement need not be symmetrical about the neutral axis, i.e., that the deck plate and hull bottom plate are not necessarily displaced an equal distance, or that only one of them is displaced in the vertical direction. Furthermore, if there are more than two moonpools, it may be appropriate to have different vertical displacement between the different moonpools. Irrespective of the number of moonpools provided in the hull, it may be appropriate to displace the deck area and the hull bottom area abaft of the moonpool located closest to the ship's stem, and forward of the moonpool that is most forward in the longitudinal direction. These displacements of the ship need not be of the same magnitude, nor does it need to be related to any displacement of the deck and/or hull bottom plates between several moonpools. Displacement in the vertical direction of deck plates and hull bottom plates abaft and forward of the moonpools positioned at the extremes in the longitudinal direction, may also be combined with a gradual stepping, a linear junction or an approximately arcuate junction between the displaced area and the rest of the deck and/or hull bottom area.

What is claimed is:

1. A ship for use in offshore operations, in said ship's hull structure comprising a plurality of moonpools, first hull bottom areas between adjacent moonpools being displaced upwardly in relation to remaining, second hull bottom areas, positioning said first, upwardly displaced hull bottom areas vertically closer the ship's transverse neutral axis, wherein said first hull bottom areas and said second hull bottom areas overlap.

2. A ship for use in offshore operations as set forth in claim 1, said ship's deck structure surrounding a small upper portion of each of a plurality of moonpools, first deck areas between adjacent moonpools being displaced downwardly in relation to remaining, second deck areas, positioning said first, downwardly displaced deck areas vertically closer to the ship's transverse neutral axis.

3. A ship for use in offshore operations, comprising a moonpool passing through a hole in the ship's hull bottom, first hull bottom areas adjacent to said moonpool being displaced upwardly in relation to remaining, second hull bottom areas, to a level closer to the ship's transverse neutral axis, but spaced a substantial distance from said transverse neutral axis, wherein said moonpool also passes through a hole in the ship's deck structure, first deck areas adjacent to said moonpool being displaced downwardly in relation to second deck areas, to a level closer to the ship's transverse neutral axis, but spaced a substantial distance from said transverse neutral axis.

4. A ship for use in offshore operations as set forth in claim 3, wherein intermediate transition areas between said first and second deck areas extend steplessly, sloping from the higher level of said second deck areas to the lower level of said first deck areas.

5. A ship for use in offshore operations, comprising a moonpool passing through a hole in the ship's hull bottom, first hull bottom areas adjacent to said moonpool being displaced upwardly in relation to remaining, second hull bottom areas, to a level closer to the ship's transverse neutral axis, but spaced a substantial distance from said transverse neutral axis, wherein said moonpool is also passed through a hole in the ship's deck structure, first deck areas adjacent to said moonpool being displaced downwardly in relation to remaining, second deck areas, to a level closer to the ship's transverse neutral axis, but spaced a substantial distance from said transverse neutral axis.

6. A ship for use in offshore operations as set forth in claim 5, wherein intermediate transition areas between said first and second hull bottom areas extend steplessly, sloping from the higher level of said first hull bottom areas to the lower level of said second hull bottom areas, intermediate transition areas between said first and second deck areas extend steplessly, sloping from the higher level of said second deck areas to the lower level of said first deck areas.

7. A ship for use in offshore operations, comprising a moonpool passing through a hole in the ship's hull bottom, first hull bottom areas adjacent to said moonpool being displaced upwardly in relation to remaining, second hull bottom areas, to a level closer to the ship's transverse neutral axis, but spaced a substantial distance from said transverse neutral axis, wherein intermediate transition areas between said first and second hull bottom areas extend steplessly, sloping from the higher level of said first hull bottom areas to the lower level of said second hull bottom areas.

* * * * *